United States Patent [19]

Tarcy et al.

[11] Patent Number: 5,037,608

[45] Date of Patent: Aug. 6, 1991

[54] METHOD FOR MAKING A LIGHT METAL-RARE EARTH METAL ALLOY

[75] Inventors: Gary P. Tarcy, Plum Boro; Perry A. Foster, Jr., New Kensington, both of Pa.

[73] Assignee: Aluminum Company of America, Pittsburgh, Pa.

[21] Appl. No.: 291,505

[22] Filed: Dec. 29, 1988

[51] Int. Cl.[5] ..... C22C 23/06

[52] U.S. Cl. ..... 420/528; 420/405; 420/590; 75/959

[58] Field of Search ..... 75/256, 27, 959; 420/590, 402, 405, 528

[56] References Cited

U.S. PATENT DOCUMENTS

| | | | |
|---|---|---|---|
| 2,911,297 | 11/1959 | Florenz | 75/135 |
| 3,380,820 | 4/1968 | Hetke et al. | 75/138 |
| 3,395,001 | 7/1968 | Stroup et al. | 29/197.5 |
| 3,503,738 | 3/1970 | Cooper | 420/528 |
| 3,522,021 | 7/1970 | Cook et al. | 29/197 |
| 3,592,637 | 7/1971 | Brown et al. | 75/138 |
| 3,619,181 | 11/1971 | Willey | 75/138 |
| 3,729,397 | 4/1973 | Goldsmith | 204/64 |
| 3,846,121 | 11/1974 | Schmidt et al. | 75/62 |
| 3,855,087 | 12/1974 | Yamanaka et al. | 204/71 |
| 3,935,004 | 1/1976 | Faunce | 75/68 R |
| 3,941,588 | 3/1976 | Dremann | 75/94 |
| 4,108,645 | 8/1978 | Mitchell et al. | 420/590 |
| 4,171,215 | 10/1979 | Dremann | 75/0.5 B |
| 4,648,901 | 3/1987 | Murray et al. | 75/68 R |
| 4,689,090 | 8/1987 | Sawtell et al. | 148/2 |

FOREIGN PATENT DOCUMENTS

| | | |
|---|---|---|
| 2350406 | 4/1974 | Fed. Rep. of Germany . |
| 2555611 | 5/1985 | France . |
| 197979 | 6/1967 | U.S.S.R. . |
| 283589 | 12/1981 | U.S.S.R. . |
| 873692 | 11/1983 | U.S.S.R. . |

*Primary Examiner*—Melvyn J. Andrews

*Attorney, Agent, or Firm*—Gary P. Topolosky; Daniel A. Sullivan, Jr.

[57] ABSTRACT

A method for making a light metal-rare earth metal alloy comprises adding a pellet to a bath of molten light metal, said pellet consisting essentially of a mixture of light metal powder and rare earth metal-containing compound. Such pellets, which are made under pressures of about 9 ksi or more, are preferably added to molten baths of aluminum, magnesium or combinations thereof. The light metal powders and rare earth metal-containing compounds that are mixed together to form said pellets are preferably substantially similar in terms of median particle size. This method is suitable for aluminothermically reducing scandium oxide to make aluminum-scandium alloy therefrom.

17 Claims, 2 Drawing Sheets

% REDUCTION FOR BOTH AL POWDERS VS DENSITY

METHOD FOR MAKING A LIGHT METAL-RARE EARTH METAL ALLOY

BACKGROUND OF THE INVENTION

This invention relates to the production of light metal alloys having improved combinations of properties. The invention further relates to a method for making light metal-rare earth metal alloys from pellets of light metal powder and rare earth metal-containing compound. More particularly, the invention relates to a method for aluminothermically reducing scandium oxide to form aluminum-scandium alloys therefrom.

In the field of alloy development, research is continuously conducted on methods for improving the behavioral characteristics of existing aluminum, magnesium and other light metal alloys. Additional research is directed to the development of new alloy compositions having desired property combinations. For nuclear and aerospace applications, aluminum-based or magnesium-based alloys are often preferred because of their relatively high strength-to-weight ratios and corrosion resistance. Such alloys could be made more attractive to aerospace product manufacturers if rare earth metals were efficiently and economically incorporated into their compositions. That is because even trace amounts of rare earth metals tend to improve corrosion resistance still further while positively affecting relative alloy density. Minor additions of scandium, for example, are known to improve the tensile and yield strengths of an aluminum alloy according to U.S. Pat. No. 3,619,181. Scandium additions of up to about 10% also contribute to the superplastic formability of aluminum alloy products according to U.S. Pat. No. 4,689,090. Still further improvements may be realized by adding rare earth metals to aluminum brazing alloys (as in U.S. Pat. No. 3,395,001) or by metalliding aluminum surfaces with rare earth metals (as in U.S. Pat. No. 3,522,021). According to Russian Patent Nos. 283,589 and 569,638, scandium additions to magnesium-based alloys improve foundry characteristics, corrosion resistance and/or mechanical strengths.

Although rare earth metal additions improve certain light metal alloy properties, they have not been added to aluminum or magnesium on a commercial scale due, in part, to the difficulty and expense of removing rare earths from the ores containing them. Presently known methods for producing "ingot quality" scandium, for example, require steps for first converting scandium oxide to $ScF_3$ using hydrofluoric acid, reducing the scandium fluoride to a salt with calcium, then vacuum melting the scandium from this salt. Unfortunately, this production method is rather costly and inefficient. About fifty percent (50%) of the scandium within ore treated by this method is not recovered. In addition, the "ingot quality" scandium alloy that is produced typically contains minor amounts of titanium and/or tungsten which are absorbed from the containers used in the aforementioned recovery method.

In U.S. Pat. No. 3,846,121, an alternative method for producing scandium metal was disclosed which consists of firing scandium oxide in air to remove any volatile residues therefrom; chlorinating air-fired oxides with phosgene; then reducing the $ScCl_3$ to magnesium-scandium for subsequent purification by vacuum distillation or arc-melting. Once scandium has been isolated from its ore by one of these methods, it must still be alloyed with one or more other metals. Such rare earth metal additions pose their own set of complications, however. If a scandium ingot was added directly to a molten aluminum bath, scandium aluminide intermetallics would first form, said intermetallics having melting temperatures hundreds of degrees higher than those associated with aluminum alone. With the increased presence of these intermetallics, alloy mixing would have to be slowed, thereby resulting in an increased chance of producing inhomogenous alloy products therefrom.

Several direct means for making light metal-rare earth metal alloys are also known. U.S. Pat. No. 3,855,087, for example, codeposits rare earth metal and aluminum (or magnesium) onto a solid molybdenum, tungsten or tantalum cathode rod by simultaneously reducing oxides of both metals in a molten bath containing LiF and preferred rare earth metal fluorides. The alloy that is produced collects in a non-reactive refractory receptacle placed beneath the cathode rod. West German Patent Application No. 2,350,406 shows a similar method for producing light metal-rare earth metal master alloy by electrolytically reducing combinations of light metal oxide and rare earth metal oxide in another fluoride salt bath.

In U.S. Pat. No. 3,729,397, there is claimed a method for making magnesium-rare earth metal alloys by electrolytically reducing rare earth metal oxides in a salt bath using a molten magnesium cathode. Once reduced rare earth metal deposits on the molten cathode confined to a boron nitride sleeve, magnesium-rare earth metal alloy is physically recovered from the sleeve through such mechanical means as ladling, tapping or the like.

French Patent No. 2,555,611 shows a method for reacting rare earth metal oxide with an aluminum powder, preferably under an inert gas cover maintained at atmospheric pressure. When a homogeneous mixture of the aforementioned components is heated at temperatures exceeding 700° C., or well above the melting point for aluminum, an aluminum oxide by-product forms which may be skimmed from the molten alloy surface. In Russian Patent No. 873,692, there is disclosed a method for preparing aluminum-scandium master alloy by combining aluminum powder with scandium fluoride under vacuum in three temperature-increasing stages. Said method is intended to lower the fluoride content of the resulting master alloy.

There are also known several means for premixing certain alloying components or subcomponents. U.S. Pat. No. 2,911,297, for example, claims a process for introducing high melting temperature constituents into molten metal by combining powdered forms of one metal and a dispersing salt in a briquette, said dispersing salt being capable of evolving gases at a sufficient pressure for spontaneously disrupting the briquette following its introduction to the melt. According to the reference, this process may be used for adding pulverized manganese, copper, nickel or chromium to molten metals.

In U.S. Pat. No. 3,380,820, there is shown a method for making aluminum alloys containing between 2–25% iron. The method includes mixing aluminum with iron particles having a maximum dimension of less than one inch, compressing this mixture into a briquette, and melting the briquette before casting it into a desired shape.

U.S. Pat. No. 3,592,637 claims an improved process for making direct metal additions to molten aluminum. The process commences by blending finely-divided aluminum powder with one or more other finely-divided metals selected from: Mn, Cr, W, Mo, Ti, V, Fe, Co, Cu, Ni, Cd, Ta, Zr, Hf, Ag and alloys thereof. Mixtures of these two (or more) metals are then compacted to about 65–95% of their maximum theoretical density. In U.S. Pat. No. 4,648,901, the aluminum and other metal component(s) from the preceding patent were further admixed with a flux of potassium cryolite, potassium chloride, potassium fluoride, sodium chloride, sodium fluoride and/or sodium carbonate before compaction into "tablets".

In U.S. Pat. No. 3,935,004, recovery efficiencies are enhanced by pelletizing aluminum alloying components such as manganese, chromium and iron with up to 2.5% of a non-hygroscopic fluxing salt and, if necessary, a small amount of binder material. Before these alloying components are combined with flux (and binder), they are first reduced to an average particle size less than about 0.25 mm using conventional grinding techniques.

U.S. Pat. No. 3,941,588 shows still other means for incorporating materials into a molten metal bath. Specifically, alloying metals such as manganese or chromium, in particulate form, are admixed with flux and a finely divided phenolic resin, preferably in the form of low density microballoons. The foregoing composition is then added to molten aluminum as a powder or in lump, bag or briquette form. In U.S. Pat. No. 4,171,215, finely divided beta manganese particles are blended with aluminum powder before compaction into readily usable briquettes.

BRIEF DESCRIPTION OF THE INVENTION

It is a principal object of this invention to provide efficient and economical means for making light metal-rare earth metal alloys. It is a further object to provide an improved method for making such alloys from rare earth metal compounds without having to first reduce the compounds to rare earth metal. It is still another object to provide means for reducing rare earth metal oxides and/or halides to make light metal-rare earth metal master alloys therefrom, said means including pelletizing mixtures of finely-divided light metal and a rare earth metal oxide (or halide) at low to intermediate temperatures well below the melting temperature of the light metal being pelletized. With pressures of about 9 ksi or more, the invention compacts blends of powdered light metal and rare earth metal compounds into a more convenient form for adding to any wetting molten metal bath. When ambient temperatures are used for pelletizing purposes, even fewer handling, processing and/or equipment complications result since cool-down delays and/or quenching steps are made unnecessary.

It is another object to provide means for aluminothermically reducing scandium oxide to form aluminum-scandium alloys therefrom. Preferred embodiments of this invention generally require fewer steps than the Al-Sc or Mg-Sc formation methods summarized above. Implementation of this method would also be commercially practical from a capital investment standpoint provided that pellet-forming presses may be shared with or borrowed from other metallurgical operations. The need for special distillation equipment, as required for halogen-based rare earth metal compound reductions, is also eliminated by the present method. After composite pellets are formed according to the invention, they may be added to most any existing or subsequently developed alloy composition capable of wetting or reacting with said pellets while in a molten state. No special equipment is required to react and dissolve these pellets in molten metal bath. The aluminum oxide by-product which forms may be removed by conventional or subsequently-developed means. There is also no need to maintain the reacting containment of this invention in any sort of inert, vacuum or other special atmosphere, unlike the prior art reaction set forth in French Patent No. 2,555,611.

It is another principal object to provide a method for adding rare earth metal, as an oxide, to molten metal baths. It is a further object to provide controlled means for alloying aluminum and scandium together while being able to accurately predict large-scale melt compositions from simple bench scale experiments. It is still another object to provide means for reducing mixtures of light metal powder and rare earth metal compound to a stable intermetallic. It is a further object to cause the aforementioned mixture to reduce and/or react within the pellet, rather than in the melt to which the pellet is added. In this manner, the invention is less dependent on such critical melt-reduction factors as: temperature of the molten metal to which pellets are fed; the length of time for which these pellets are exposed to molten metal; the size of the molten metal pool; and the extent to which this pool is mixed after a pellet is added thereto. It is still another object to produce aluminum-scandium alloys while using as little aluminum powder as necessary, said powder being much more costly to produce than most other forms of aluminum metal.

In accordance with the foregoing objects and advantages, there is provided a method for making light metal-rare earth metal alloys by adding a pellet to a bath of molten light metal, said pellet consisting essentially of a mixture of powdered light metal and rare earth metal-containing compound. The invention manufactures such pellets using relatively high pressures of about 9 ksi or more. On a preferred basis, these pellets are added to molten baths of aluminum, magnesium, their alloys and combinations thereof. However, pre-pelletizing may also be used for alloying rare earths and other metal compounds with still other metal alloys. For better reduction efficiency, the light metal powders and rare earth metal compounds to be combined under this method should be substantially similarly-sized in terms of median particle size. The invention may be particularly useful for aluminothermically reducing scandium oxide to make aluminum-scandium alloys therefrom.

BRIEF DESCRIPTION OF THE DRAWINGS

Further features, other objects and advantages of this invention will become clearer from the following detailed description of the preferred embodiments made with reference to the drawings in which.

DETAILED DESCRIPTION OF THE PREFERRED EMBODIMENTS

In accordance with the preferred embodiments of this invention, there is disclosed a method for making light metal-rare earth metal alloys having improved combinations of properties. The metal alloys that are produced may contain up to about 35 wt. % rare earth metal, though maximum contents of about 12–15% rare earth metal are more typical. On a more preferred basis, the alloy compositions resulting from this method include about 0.5–10 wt. % rare earth metal. The term "light metal" as used herein, shall mean any metallic element (or alloy) having a relatively low density, commonly below about 4 g/cc. Although aluminum and magnesium are representative of such elements, it is to be understood that still other light metals, such as barium, calcium, potassium, sodium, silicon and selenium, may be alloyed in a similar manner. By use of the terms "aluminum" and "magnesium" with reference to metal powders or molten metal bath compositions, it should be further understood that such terms cover both the substantially pure forms of each metal, as well as any alloy having aluminum or magnesium as its major alloying component.

The rare earth metals alloyed with light metal according to the invention include the entire Lanthanide series of elements from the Periodic Table. The elements from this series specifically include: lanthanum, cerium, praseodymium, neodymium, promethium, samarium, europium, gadolinium, terbium, dysprosium, holmium, erbium, thulium, ytterbium and lutetium. The invention also works especially well with scandium and yttrium, two other metals commonly grouped with the foregoing because of their similar properties and behavioral characteristics. It is to be understood, however, that the method of this invention may also be used to add compounds of still other metals, such as zirconium and hafnium, to molten aluminum or the like.

The detailed description which follows is periodically specific for producing an alloy composition wherein the light metal powder is aluminum and rare earth metal compound combined with aluminum consists essentially of scandium oxide. The pellets that are formed are then added to a molten aluminum bath. It is to be understood, however, that the foregoing combination is merely representative of the invention and that other combinations of light metal-rare earth metal compounds may also be alloyed in a similar manner.

Figure 1:
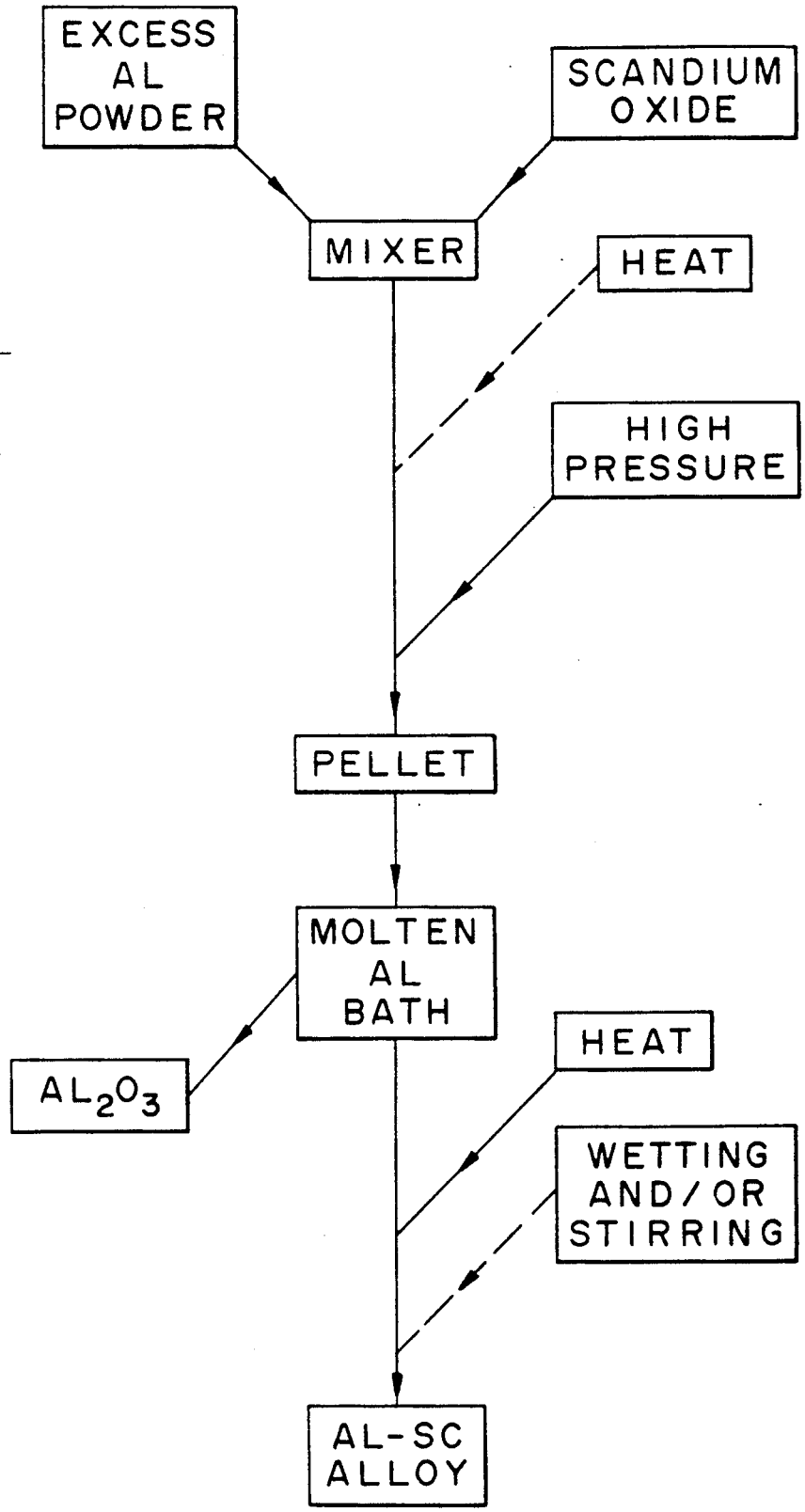
FIG. 1 is a flow chart outlining a preferred embodiment of the invention.

Referring to accompanying FIG. 1, there is chronologically shown the steps of one preferred method for making aluminum-scandium according to the invention. The method commences by providing scandium oxide powder with excess powdered aluminum in a mixer. After making a substantially homogeneous mixture from these two powders, the mixture is compacted into one or more pellets by the application of high pressures thereto. Some heat may also be applied to the pelletizing mixture at this point for enhancing the rate and/or efficiency of compaction. Such heating is neither necessary nor sufficient to the invention, however, as shown by the dotted, rather than solid arrow in FIG. 1. When high pressures from about 9 to 15, 20 or 30 ksi or more are used to pelletize metal-metal oxide mixtures at ambient temperatures (at or near room temperature) according to the invention, such lower temperature compaction contributes significantly to the ease in pellet formation and further processing. Specifically, it eliminates any need for pellet cool-down periods and/or extra heat quenching steps.

After a sufficient number of Al—$Sc_2O_3$ pellets have been formed, they may be fed to a containment of molten aluminum (or other light metal bath). Although these pellets contribute both aluminum and scandium to the melt, typically over 90% of the aluminum comprising the end product comes from the melt rather than being derived from more costly aluminum powders. Soon after pellets begin to dissolve in this melt, an aluminum oxide ($Al_2O_3$) by-product forms and floats on the molten metal surface. It is most preferred that said by-product be physically removed from the melt. Depending on the intended end use for said alloy, the resulting Al—Sc alloy may tolerate some degree of internal $Al_2O_3$ contamination. For still other applications where substantially all aluminum oxide should be removed prior to dilution, casting or further alloying, this may be best accomplished by passing all molten metal through a filter or other impurity collection means.

Should compacted pellets of reactants dissolve more slowly than desired, optional wetting and/or stirring steps may be performed, as shown by the dotted arrow in accompanying FIG. 1. By "pellet wetting", it is meant that some pellets may have to be treated, coated or otherwise handled in some way to make them more receptive to reacting with aluminum (or another molten light metal). For compacted pellets of Al—$Sc_2O_3$ which tend to float on a molten aluminum surface, a common wetting step consists of pushing or holding these pellets beneath the surface of the melt until a sufficient amount of aluminum has coated the pellet surface. Wetting has also been encouraged or enhanced by adding minor amounts of fluxes or salt to the Al—$Sc_2O_3$ mixture before it is pelletized. Suitable fluxes for aluminum-scandium wetting purposes include most any molten metal fluoride or chloride.

In preferred embodiments, the molar ratio of aluminum (or light metal) to scandium oxide (or rare earth metal compound) contributes significantly to the reduction efficiencies of this method. For commercially practical applications, the molar ratio of aluminum to scandium oxide in a compacted mixture should range from about 30 to more than about 90 or 100. In other words, aluminum should clearly be present as a substantial majority in each pellet mixture. On a more preferred basis, the molar ratio of aluminum to scandium oxide in mixtures to be pelletized should range from about 40 to about 75. Although pellets containing Al:$Sc_2O_3$ molar ratios below 30 will still react to form an Al—Sc alloy, such pellet mixtures are generally believed to react at lower efficiencies than are commercially acceptable.

Relative particle size has also been determined to be influential on rare earth metal compound reduction efficiencies. For pellet homogeneity and improved density purposes, the light metal powder and rare earth metal-containing compound to be mixed together should be substantially similarly-sized (or as close to one another in median particle size as possible). That is because when particles of one component are larger than those of the other component, a greater number of voids within the pellet result. Such voids are especially detrimental to the reduction reaction which follows since: (i) reactants do not diffuse across voids; (ii) voids contain air that can react with aluminum-scandium intermetallics to form undesirable oxides, nitrides and/or oxynitrides; and (iii) any expansion of the gases trapped in a void may cause premature disruption of the pellet.

In preferred embodiments, the ratio of aluminum to scandium oxide powder particle sizes combined according to the invention ranges from about 0.5 to about 2. On a more preferred basis, these powder size ratios range from about 0.75 to about 1.5. Theoretically, therefore, a 1:1 ratio in particle size for powdered Al and $Sc_2O_3$ should reduce most efficiently if homogeneously mixed.

Figure 2:
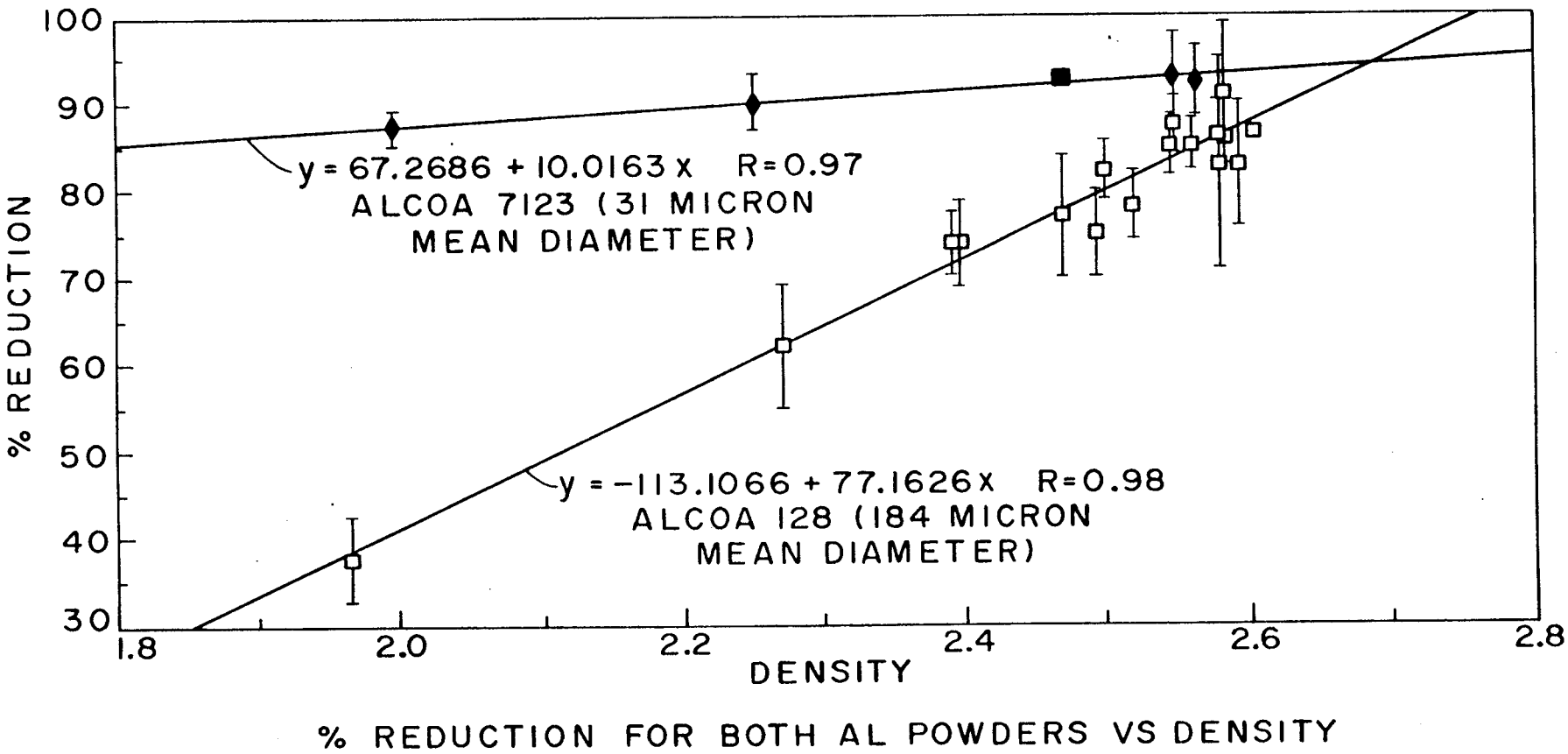
FIG. 2 is a graph showing the percentage of rare earth metal oxide reduced as a function of pellet density and aluminum powder particle size.

In accompanying FIG. 2, there is shown a graph plotting the effect of Al particle size and pellet density on the percentage of scandium oxide reduced according to one preferred embodiment. Experimental data from two different sizes of aluminum powder were plotted in this figure. From the plots at FIG. 2, it appears that density is less critical to the reduction capacities of small or medium particles than for larger aluminum powders. The smaller particles (designated Alcoa 7123 aluminum in FIG. 2), for example, measured about 31 microns in mean particle size with no particles larger than 212 microns or smaller than 2.4 microns. When combined with a $Sc_2O_3$ powder having a binodal distribution with one peak at 10 microns and a second at 30 microns, with a mean particle size of about 12 microns and no particles larger than 45 microns or smaller than 1 micron, the resulting pellets produced reduction efficiencies ranging from about 85 to 95% over densities from 1.8 to 2.8 (g/cc), said densities varying with different compaction pressures. Over the same range of densities, a pellet made with the same $Sc_2O_3$ powder and a larger Al particle (designated Alcoa 128 aluminum and having a mean of about 184 microns with only 0.4% being below about 63 microns and with only 3% larger than about 354 microns) varied in reduction efficiency from about 30% to a theoretical 100% by line extrapolation.

Without limiting the scope of this invention in any manner, it is believed that light metal particle size affects the overall reduction rate by creating different surface-to-volume ratios for rare earth metal compounds. Any change to this ratio translates to changes in the average diffusion length that reactants must traverse within a compacted pellet. Hence, average diffusion lengths are much shorter or lower for smaller aluminum particles. With shorter diffusion distances, scandium oxide particles within the pellets of this invention react more readily thereby speeding up the dissolution of scandium throughout the melt.

From FIG. 2, it is also clear that generally higher pellet densities were produced with the larger powder (Alcoa 128 aluminum). This is believed to be due to the greater deformability associated with larger particles. As a whole, the method of this invention is considered to be substantially diffusion limited. Accordingly, reduction efficiencies of nearly 100% should be possible once the best combination of the following factors has been found: reactant concentration, diffusion distance and flux rate.

While the inventors do not wish to be bound by any theory of operation, it is believed that their preferred alloying method proceeds by first reducing scandium oxide within the pellet to form a series of aluminum-scandium intermetallic compounds ranging from $Sc_2Al$ to ScAl, $ScAl_2$ and finally to $ScAl_3$. Once these compacted pellets are wetted with molten aluminum, the following reaction is believed to occur:

$$8Al + Sc_2O_3 \rightarrow 2Al_3Sc + Al_2O_3.$$

Following the formation of a stable Al-Sc intermetallic, aluminum and scandium will be dispersed (or dissolved) throughout the molten metal bath. Of course, rare earth metal dispersal may be further enhanced with homogeneous mixing or periodic stirring of the bath. When one particular experimental reaction was interrupted before its completion, sections of an undissolved pellet were removed from the melt, visually examined and analyzed by Guinier X-ray analysis. The latter analysis detected a clear majority of aluminum metal within the undissolved pellet. This same pellet further contained about 10–25% $Al_3Sc$, 5–10% $Sc_2O_3$ and about 5–10% ($Al_3O_3N$ and/or $\eta Al_2O_3$), however.

Suitable means for compressing (or compacting) a mixture of light metal and rare earth metal compound into a pellet include uniaxial cold pressing, isostatic pressing and/or hot pressing. Other suitable extrusion or pressing equipment may also be readily substituted for the aforementioned. When these compressed pellets are reacted with molten light metal to form a light metal-rare earth metal alloy (or master alloy) according to the invention, it is further preferred that most aluminum oxide by-product which forms be removed from the melt. Although this by-product tends to float on the molten metal surface for removal by tapping, surface skimming, or the like, it is more advantageous to filter all molten alloy produced to assure that substantially all undesirable contaminants are removed.

Should the method of this invention be practiced for making aluminum-scandium master alloys, following its formation, the master alloy may be diluted with aluminum and/or other metals (in powder, liquid or other forms) using any known or subsequently developed technique. Exemplary end uses for such rare earth metal-containing alloys can be found in U.S. Pat. Nos. 3,619,181 and 4,689,090, the disclosures of which are fully incorporated by reference herein. For most aerospace applications, aluminum-based alloy products containing between about 0.05–0.5% rare earth metal may be used to enhance weight reductions while providing still further improvements to strength, density, formability, corrosion resistance and/or other properties.

The following examples are provided by way of further illustration. They are not intended to limit the scope of this invention in any manner.

EXAMPLES 1–37

Experimental test data from Examples 1–37 are set forth in following Table 1 in which the columns designate, from left to right: the particular melt number assigned to an experiment (A); the average density (g/cc) of said melt (B); the average percent reduction of $Sc_2O_3$ in these pellets (C); the variation in the percent reduction at a 95% confidence interval (D); the amount of pressure (kpsi) used to compact each pellet (E); the types of aluminum powder (or aluminum/salt blend) combined with $Sc_2O_3$ according to the invention (F); the overall diameter (in inches) of the compacted pellet (G); total molten metal bath size in grams (H); the temperature at which the molten aluminum bath was maintained during these experiments (I); the percentage of scandium oxide originally added to a mixture for pelletizing (J); the theoretical amount of scandium (%) transferred to the melt at about 100% reduction efficiency (K); and the number of hours for each experiment (L).

For purposes of melts 22 through 24, aluminum powders were combined with excessive amounts of the following salts: Salt A consisted of 63.9% $AlF_3$ and 36.1% KF (melting point (M.P.) of 560° C.); Salt B contained 41.25% B, 33.75 KCl, the balance NaCl (M.P.=640° C.) and Salt C consisted of about 29.6% $AlF_3$, 70.4% $Na_3AlF_6$ (M.P.=685° C.). Although none of the aluminum/salt mixtures tested produced reduction efficiencies greater than about 3%, as compared to the routinely obtained efficiency of 85%, it is still believed that salt additions to a pelletizing mixture of up to about 1 wt. % may still enhance wetting and thus overall reaction rate.

The aforementioned components were first manually mixed, followed by some tumble mixing. After homogeneous mixing, respective powder blends were poured into a cylindrical die previously lubricated with isostearic acid. Pellets having a diameter of either 0.375, 0.5 or 1.125 inch were then uniaxially pressed using a Carver Hydraulic Press Model #M, pressures ranging from about 6 to about 60 ksi and a standard pressing temperature of about 25° C.

To produce an experimental aluminum-scandium alloy with the foregoing pellets, an alumina crucible was acetone washed and supplied with 99.999% aluminum melted to the respective temperatures set forth in Table 1. Such melting occurred under ambient atmospheric conditions, however. For most experiments, only about 2 pellets were added before being physically submerged below the molten metal surface to effect their wetting. Except for Example 34(d), in which 1156 pellets were stirred into the melt at 5-minute intervals to cast about 600 pounds of master alloy, most experiments in Table 1 required adding only one or two pellets to each molten bath. In most cases, the pellets that were added appeared to have dissolved after only about 30–45 minutes of exposure time. Samples of molten metal removed from these respective melts were then sent for compositional analysis by acetylene flame atomic adsorption spectroscopy. The theoretical percentages of scandium transferred from its oxide form, through a stable Al-Sc intermetallic, and into the melt are also listed for each completed experiment in the next-to-last column of following Table 1.

TABLE 1

EXPERIMENTAL DATA FROM Al—$Sc_2O_3$ REDUCTION TESTS

| | Col. A MELT # | B AVG. DEN. g/cc | C AVG. % RE-DUCT. | D 95% CON. INT. | E PELLET KPSI | F AL. POWDER | G PELLET SIZE, In. | H TOTAL MELT SIZE, g | I MELT TEMP, C. | J % SC2O3 IN PELLET | K THEOR % SC IN ALLOY | L MELT HR'S |
|---|---|---|---|---|---|---|---|---|---|---|---|---|
| a | 1 | 2.47not | 73 | 15 | 25 | FISHER | 0.375 | 454 | 975 | 7.469 | 0.2 | 18.25 |
| a | 2 | 2.55det | 83.3 | 2.3 | 36 | A-547 | 0.375 | 686.3 | 900 | 7.825 | 0.5 | 24 |
| a | 3 | 2.5 | 83 | 3.8 | 36 | 128 | 0.375 | 1365 | 900 | 7.826 | 0.5 | 2 |
| a | 4 | 2.5 | 84.4 | 4.2 | 36 | 128 | 0.375 | 1365 | 900 | 7.826 | 0.5 | 3 |
| a | 5 | INVALID TEST. NO SAMPLES TAKEN. | | | | | | | | | 7.826 | |
| a | 6 | 2.55 | 87.3 | 3 | 36 | 128 | 0.375 | 1361.36 | 800 | 4.8464 | 0.3 | 3 |
| a | 7 | 2.5 | 82.2 | 3.3 | 36 | 128 | 0.375 | 680.5 | 900 | 7.8246 | 0.501 | 2 |
| a | 8 | 2.562 | 85 | 2.8 | 36 | 128 | 1.125 | 8011 | 750 | 7.271 | 0.47 | 2 |
| | 9 | 2.58 | 86.2 | 3.9 | 36 | 128 | 1.125 | 682.15 | 750 | 7.247 | 0.587 | 2.5 |
| | 10 | 2.393 | 73.7 | 5.1 | 18 | 128 | 1.125 | 682.15 | 750 | 7.247 | 0.587 | 2.75 |
| | 11 | 2.52 | 78 | 3.9 | 27 | 128 | 1.125 | 682.15 | 750 | 7.247 | 0.587 | 2 |
| | 12 | 2.586 | 86.2 | 4 | 45 | 128 | 1.125 | 682.15 | 750 | 7.247 | 0.587 | 2 |
| | 13 | 2.603 | 86.8 | 0 | 50 | 128 | 1.125 | 682.15 | 750 | 7.247 | 0.587 | 2.5 |
| | 14 | 2.392 | 73.8 | 3.8 | 18 | 128 | 1.125 | 682.15 | 750 | 7.247 | 0.587 | 2.3 |
| | 15 | 2.495 | 75 | 4.8 | 27 | 128 | 1.125 | 682.15 | 750 | 7.247 | 0.587 | 2.25 |
| | 16 | 1.965 | 37.5 | 4.8 | 6 | 128 | 1.125 | 682.15 | 750 | 7.247 | 0.587 | 7 |
| | 17 | 2.471 | 76.9 | 6.7 | 24 | 128 | 1.125 | 682.15 | 750 | 7.247 | 0.587 | 2.2 |
| | 18 | 2.592 | 82.9 | 7.1 | 50 | 128 | 1.125 | 682.15 | 750 | 7.247 | 0.587 | 1.75 |
| | 19 | 2.27 | 62.1 | 7.2 | 12 | 128 | 1.125 | 682.15 | 750 | 7.247 | 0.587 | 2.25 |
| b | 20 | 2.556 | 70.4 | 5.2 | 36 | 128 | 1.125 | 682.15 | 750 | 7.247 | 0.587 | 2.25 |
| | 21 | 2.482 | 88 | 2 | 36 | 7123 | 1.125 | 682.15 | 750 | 7.247 | 0.587 | 2 |
| | 22 | 2.56 | 2.8 | 2 | 36 | 128/SALT "A" | 1.125 | 682.15 | 750(780) | 7.247 | 0.587 | 2.25 |
| | 23 | 2.555 | 1.7 | 0 | 36 | 128/SALT "C" | 1.125 | 682.15 | 750(762) | 7.247 | 0.587 | 3.5 |
| | 24 | 2.56 | 1.7 | 0 | 36 | 128/SALT "B" | 1.125 | 682.15 | 750(867) | 7.247 | 0.587 | 3 |
| c | 25 | 2.461 | 5.1 | 0 | 36 | 128 | 1.125 | 682.15 | 750 | 15.625 | 0.587 | 2.25 |
| c | 26 | 2.584 | 91 | 8 | 36 | 128 | 1.125 | 682.15 | 750 | 3.906 | 0.587 | 2 |
| c | 27 | 2.543 | 62 | 5 | 36 | 128 | 0.375 | 682.15 | 750 | 7.247 | 0.587 | 2.25 |
| | 28 | 2.565 | 92.2 | 3.9 | 60 | 7123 | 0.5 | 682.15 | 750 | 7.247 | 0.587 | 2 |
| | 29 | 1.994 | 87 | 2 | 9 | 7123 | 1.125 | 682.15 | 750 | 7.247 | 0.587 | 3 |
| | 30 | 2.548 | 92.8 | 5 | 50 | 7123 | 1.125 | 682.15 | 750 | 7.247 | 0.587 | 1.8 |
| | 31 | 2.25 | 90 | 3.3 | 18 | 7123 | 1.125 | 682.15 | 750 | 7.247 | 0.587 | 1.75 |
| | 32 | 2.4694 | 92.8 | 1.1 | 36 | 7123 | 1.125 | 682.15 | 750 | 7.247 | 0.587 | 1.92 |
| | 33 | 2.6077 | 74.1 | 3.9 | 36 | 128 | 1.125 | 682.15 | 750 | 3.906 | 0.587 | 2.1 |
| | 34 | 2.474 | 14 | 0 | 36 | 128 | 1.125 | 682.15 | 750 | 15.625 | 0.587 | 2.67 |
| d | 600 LBS | 2.546 | 85 | 3.3 | 36 | 128 | 1.125 | 272160 | 760/815 | 7.247 | 0.587 | 4 |
| | 35 | 2.612 | 83 | 2 | 36 | 128 | 1.125 | 682.15 | 750 | 3.906 | 0.587 | 2 |
| | 36 | 2.531 | 65.6 | 2 | 36 | 128 | 0.375 | 682.15 | 750 | 7.247 | 0.587 | 1.83 |
| e | 37 | 2.58 | 83 | 12 | 36 | 128 | 1.125 | 682.15 | 750 | 7.247 | 0.587 | 4.4 |

a. Laboratory Notebook numbers unavailable
b. 5 g Al CAP B/4 Pressing. 8.05% $Sc_2O_3$
c. No mixing of melt
d. 1156 Pellets stirred at 5-minute intervals
e. Mechanically stirred at 200 rpm From the experimental data in Table 1, it is clear that average reduction efficiencies of the invention (column C) are substantially independent of such melt reduction factors as the total number of pounds of Al-Sc alloy made (see, column H), the temperature of the melt to which pellets were added (column I), the total percentage of scandium within a pellet (see, column J), the time spent within the melt (column L) and the melt mixing rate (see, melt nos. 25–27). This same data also supports the earlier stated belief that preferred embodiments of this invention are dependent on such pellet reduction factors as pellet density (column B) and aluminum powder particle size selected (column F). By way of this invention, it has been further determined that the following correlation between dependent factors exists:

$$\% \text{ reduction} = 108 + 90.95 * \text{density (g/cm}^3) - 1190 * \text{Al powder size (cm)} - 0.2584 * \frac{\text{density}}{\text{Al powder size}}.$$

Having described the presently preferred embodiments, it is to be understood that the present invention may be otherwise embodied within the scope of the appended claims.

What is claimed is:

1. A method for making an aluminum-scandium allow which comprises:

(a) mixing aluminum powder with a finely divided scandium-containing compound;

(b) forming a pellet from the mixture of aluminum powder and scandium compound; and (c) feeding the pellet to a molten aluminum bath.

2. A method as set forth in claim 1 which further comprises:

(d) removing aluminum-containing compound from the molten bath.

3. A method as set forth in claim 1 wherein the scandium-containing compound consists essentially of scandium oxide.

4. A method as set forth in claim 3 wherein the aluminum powder and scandium oxide are substantially similarly-sized.

5. A method as set forth in claim 1 wherein recitation (b) includes:

(i) heating the mixture to one or more temperatures below the melting point of the light metal powder; and (ii) compacting the mixture under a pressure of about 9 ksi or more.

6. A method as set forth in claim 1 wherein recitation (b) includes:

(i) pressing the mixture into a pellet having a density of about 2 g/cm$^3$ or more.

7. A method as set forth in claim 1 wherein the pellet is formed under high pressure.

8. A method as set forth in claim 1 wherein the molten aluminum bath contains up to about 1 wt. % flux.

9. A method as set forth in claim 1 wherein the scandium-containing compound includes scandium oxide.

10. A method for making an aluminum-scandium master alloy which comprises:

(a) providing a mixture of powdered aluminum and scandium oxide powder, the amount of aluminum exceeding the amount of scandium oxide in said mixture;

(b) compacting the mixture into a pellet under high pressure at one or more temperatures below about 600° C. (1112° F.);

(c) making the pellet wettable with molten aluminum;

(d) adding the pellet to a bath of molten aluminum; and (d) removing aluminum oxide from the bath.

11. A method as set forth in claim 10 wherein the aluminum and scandium oxide powders of said mixture are substantially similarly-sized.

12. A method for aluminothermically reducing scandium oxide to form an aluminum-scandium alloy therefrom, said method comprising:

(a) providing an aluminum powder having a median particle size greater than about 5 microns and less than about 150 microns;

(b) providing a scandium oxide powder having a median particle size greater than about 5 microns and less than about 150 microns;

(c) forming a mixture from the aluminum and scandium oxide powders, the molar ratio of aluminum to scandium oxide in said mixture being greater than about 30;

(d) pelletizing the mixture at a pressure of about 9 ksi or more; and (e) adding the pelletized mixture to a bath of molten aluminum.

13. A method as set forth in claim 9 wherein the ratio of aluminum powder to scandium oxide powder particle sizes ranges from about 0.5 to about 2.

14. A method for adding scandium to an aluminum alloy which comprises:

(a) providing an aluminum powder;

(b) providing scandium oxide with a median particle size close to that of the aluminum powder;

(c) mixing scandium oxide with a majority of the aluminum powder;

(d) compressing the scandium oxide- aluminum powder mixture into a pellet under high pressure; and (e) reacting the pellet with a molten aluminum bath containing up to about 1 wt. % flux.

15. A method as set forth in claim 14 which further comprises:

(f) removing aluminum oxide from the molten aluminum bath.

16. A method for alloying aluminum and scandium which comprises:

(a) providing a mixture of powdered aluminum and substantially similarly-sized scandium oxide powder, the molar ratio of aluminum to scandium oxide in said mixture being greater than about 30;

(b) pelletizing the mixture under high pressure; and (c) dissolving the pelletized mixture in a bath of wetting molten metal alloy.

17. A method as set forth in claim 16 wherein the molten metal bath is selected from aluminum, magnesium and combinations thereof.

* * * * *